US008936715B2

(12) United States Patent
Noh et al.

(10) Patent No.: US 8,936,715 B2
(45) Date of Patent: Jan. 20, 2015

(54) METHOD OF MANUFACTURING HIGH QUALITY LUBE BASE OIL USING UNCONVERTED OIL

(75) Inventors: Kyung Seok Noh, Daejeon (KR); Yong Woon Kim, Daejeon (KR); Gyung Rok Kim, Daejeon (KR); Jae Wook Ryu, Daejeon (KR); Sun Hyuk Bae, Daejeon (KR); Tae Young Jang, Daejeon (KR); Sun Choi, Daejeon (KR); Seung Hoon Oh, Seoul (KR)

(73) Assignee: SK Innovation Co., Ltd., Seoul (KR)

( * ) Notice: Subject to any disclaimer, the term of this patent is extended or adjusted under 35 U.S.C. 154(b) by 165 days.

(21) Appl. No.: 13/695,070

(22) PCT Filed: Nov. 8, 2010

(86) PCT No.: PCT/KR2010/007825

§ 371 (c)(1),
(2), (4) Date: Nov. 9, 2012

(87) PCT Pub. No.: WO2011/136451

PCT Pub. Date: Nov. 3, 2011

(65) Prior Publication Data

US 2013/0048536 A1 Feb. 28, 2013

(30) Foreign Application Priority Data

Apr. 30, 2010 (KR) ..... 10-2010-0040888

(51) Int. Cl.
*C10G 69/02* (2006.01)
*C10M 101/02* (2006.01)
(Continued)

(52) U.S. Cl.
CPC ..... *C10M 101/02* (2013.01); *C10G 45/58* (2013.01); *C10G 65/12* (2013.01);
(Continued)

(58) Field of Classification Search
USPC ..... 208/49–51, 52 R, 53–54, 58, 60
See application file for complete search history.

(56) References Cited

U.S. PATENT DOCUMENTS 4,283,271 A 8/1981 Garwood et al.
4,414,097 A 11/1983 Chester et al.
(Continued)

FOREIGN PATENT DOCUMENTS

KR 1996-0013606 B1 10/1996
KR 10-1999-021229 A 3/1999
KR 10-2010-0129943 A 12/2010
KR 10-2011-0061324 A 6/2011

OTHER PUBLICATIONS

PCT/KR2010/007825, International Search Report, Jul. 28, 2011 (2 pages).
EP2563886, EPO Supplementary search report, Dec. 11, 2013 (7 pages).

*Primary Examiner* — Brian McCaig
(74) *Attorney, Agent, or Firm* — Abelman, Frayne & Schwab

(57) ABSTRACT

Disclosed is a method of manufacturing high quality lube base oil (Group III) from unconverted oil having various properties obtained in a variety of hydrocrackers using improved catalytic dewaxing and hydrofinishing, the method including producing unconverted oil of at least one kind in the same or different hydrocrackers; subjecting the unconverted oil to vacuum distillation; supplying all or part of the distillate fractions to a catalytic dewaxing reactor; supplying the dewaxed oil fraction to a hydrofinishing reactor; and stripping the hydrofinished light oil fraction, wherein make-up hydrogen is supplied upstream of the hydrofinishing reactor to increase hydrogen partial pressure, thereby enabling high quality base oil to be manufactured at high yield under optimal process conditions using unconverted oil produced by hydrocracking under various conditions.

14 Claims, 4 Drawing Sheets

(51) Int. Cl.
*C10G 45/58* (2006.01)
*C10G 65/12* (2006.01)

(52) U.S. Cl.
CPC ..... *C10M 2203/1006* (2013.01); *C10M 2203/1025* (2013.01); *C10N 2230/02* (2013.01); *C10N 2270/00* (2013.01); *C10G 2300/1037* (2013.01); *C10G 2300/202* (2013.01); *C10G 2300/302* (2013.01); *C10G 2300/4081* (2013.01); *C10G 2300/42* (2013.01); *C10G 2300/70* (2013.01); *C10G 2400/10* (2013.01)
USPC ..... 208/60; 208/49; 208/50; 208/51; 208/52 R; 208/53; 208/54; 208/58

(56) References Cited

U.S. PATENT DOCUMENTS

| | | | | |
|---|---|---|---|---|
| 4,615,789 | A * | 10/1986 | Bridge et al. | 208/143 |
| 5,462,650 | A | 10/1995 | Takito et al. | |
| 5,935,417 | A | 8/1999 | Cody et al. | |
| 6,517,704 | B1 | 2/2003 | Carroll et al. | |
| 6,569,312 | B1 * | 5/2003 | Carroll et al. | 208/49 |
| 2006/0016724 | A1 * | 1/2006 | Miller et al. | 208/24 |
| 2012/0230883 | A1 * | 9/2012 | Jang et al. | 422/310 |

* cited by examiner

METHOD OF MANUFACTURING HIGH QUALITY LUBE BASE OIL USING UNCONVERTED OIL

TECHNICAL FIELD

The present invention relates to a method of manufacturing high quality lube base oil, including preparing a feedstock of high quality Lube base oil from unconverted oil (UCO) obtained by hydrocracking Unit and then producing high quality lube base oil from the feedstock. More particularly, the present invention relates to a method of manufacturing high quality Lube base oil (Group III), which includes preparing an optimal feedstock using UCO having various properties produced in a variety of hydrocrackers and then subjecting the feedstock to improved dewaxing and hydrofinishing process.

BACKGROUND ART

Generally, high quality Lube base oil has a high viscosity index, good stability (to e.g. oxidation, Thermal, UV, etc.) and low volatility. A classification of the quality of lube base oil according to the API (American Petroleum Institute) is shown in Table 1 below.

TABLE 1

| | Sulfur (%) | Saturate (%) | VI (Viscosity Index) |
|---|---|---|---|
| Group I | >0.03 | <90 | 80~120 |
| Group II | ≤0.03 | ≥90 | 80~120 |
| Group III | ≤0.03 | ≥90 | ≥120 |
| Group IV | All PolyAlphaOlefins (PAOs) | | |

Among mineral oil-based base oil products, base oil produced by solvent extraction mainly corresponds to Group I, base oil produced by hydrotreating mainly corresponds to Group II, and base oil having high viscosity index produced by high-degree hydrocracking mainly corresponds to Group III.

In the case where base oil is classified according to the viscosity grade, it may include Neutral base oil and Bright Stock base oil, in which the Neutral base oil typically comprises an oil fraction streaming from the tower upon vacuum distillation and the Bright Stock base oil comprises an oil fraction having very high viscosity streaming from the bottom of the tower upon vacuum distillation. In particular, base oil of Group III which is high quality Neutral base oil is referred to as Neutral in the sense that a base oil feedstock having high acidity is converted into a neutral material after refining.

The conventional preparation of a feedstock for producing Lube base oil using unconverted oil which is a heavy oil fraction that is not converted into fuel oil but remains in a fuel oil hydrocracking process is known to be a method of effectively manufacturing a feedstock of high quality lube base oil and fuel oil, as disclosed in Korean Examined Patent Publication No. 96-13606, in which unconverted oil (UCO) is drawn out directly during the recycle mode operation of a vacuum gas oil (VGO) hydrocracker to provide a feedstock for producing base oil, so that loads on first vacuum distillation (V1, atmospheric residue vacuum distillation) and hydrotreating and hydrocracking (R1 and R2) are reduced without the need to recycle the VGO back to the first vacuum distillation process (V1). Accordingly, a feedstock of high quality lube base oil having a viscosity such as 100N, 150N or the like may be prepared at significantly increased efficiency.

In this case, however, conversion of UCO having various properties produced in a variety of hydrocrackers into high quality Lube base oil is left out of consideration. (manufacturing high quality lube base oil using UCO having various properties produced in a variety of hydrocrackers is left out of consideration)

Specifically, refineries all over the world include a large various type of hydrocrackers (e.g. low-pressure hydrocracker, high-pressure hydrocracker, single-stage hydrocracker, two-stage hydrocracker, one-through, recycle mode etc.), and the feedstock thereof is very diverse (such as vacuum gas oil (VGO) or coker gas oil (CGO) and which is also depend on crude oil species adapted for the corresponding refinery). Thus, the hydrocracked residue may be produced in a large variety of different ways depending on the type and operating condition of hydrocracker and its feedstock, so some may be appropriate for high quality lube base oil production and some may be inappropriate for lube base oil production. For example, there may be hydrocracked residue favorable in terms of yield, hydrocracked residue favorable in terms of properties (including viscosity index, impurity content, etc.) of lube base oil products, or hydrocracked residue unfavorable or favorable in terms of both yield and properties. In this way, hydrocracked residue species produced using various crude oil sources, various hydrocracking feedstocks (VGO or CGO), or various type of hydrocrackers (single-stage, two-stage, high-pressure (P>about 150 kg/cm$^2$g), low-pressure (P=about 100 kg/cm$^2$g) hydrocrackers, one-through, recycle mode etc.) may have diverse properties. Furthermore, as the size of plants that produce lube base oil has recently increased, a large amount of feedstock such as hydrocracked residue (i.e. UCO) is required to perform catalyst dewaxing and hydrofinishing, but it is very difficult to produce it in a single hydrocracker. Hence, there is an urgent need for methods that effectively and economically utilize UCO having various properties from a variety of different sources.

Also, in order to manufacture high quality base oil (Group III) having high stability at high yield using the process adapted for the properties and demands of such UCO, dewaxing and hydrofinishing reactors should be optimized. In the case of dewaxing reactors used in conventional processes that produce base oil, no consideration is given to the chimney tray for uniformly dispersing a liquid/gas mixture in catalyst beds so as to maximize the use of catalyst. Also, in a quenching zone which is provided between catalyst beds so that high-temperature gas and liquid flowing down from the catalyst beds get mixed with a quenching fluid and thus are uniformly cooled below a predetermined temperature, methods able to increase the residence time of the quenching fluid to make it as long as possible for space efficiency and unclogging purposes have not been devised.

Moreover, in the hydrofinishing process, the hydrogen partial pressure should be as high as possible in order to impart final Lube base oil products with high stability (to e.g. oxidation, Thermal, UV, etc.). However, hydrogen partial pressure is lowered due to the consumption of hydrogen during the dewaxing process, conducted before the hydrofinishing process. Therefore, methods of maintaining enough hydrogen partial pressure so that the hydrofinishing process can be performed are in demand.

DISCLOSURE OF INVENTION

Technical Problem

Accordingly, the present invention has been made keeping in mind the problems encountered in the related art and the present invention is intended to provide a method of manufacturing high quality lube base oil, in which, in order to manufacture high quality lube base oil (Group III) in high yield, hydrocracked residue produced in the same or different hydrocrackers, in particular, hydrocracked residue having a complementary relationship in terms of yield and properties, is used to prepare an optimal feedstock, which is then subjected to catalytic dewaxing (isomerization) and hydrofinishing under optimal reaction conditions.

Solution to Problem

An aspect of the present invention provides a method of manufacturing high quality lube base oil, comprising producing unconverted oil of at least one kind in the same or different hydrocrackers; supplying the unconverted oil to a vacuum distillation separator, thus separating one or more distillate fractions therefrom; supplying all or part of the distillate fractions to a dewaxing reactor in the presence of an isomerization catalyst, thus obtaining a dewaxed oil fraction; and supplying the dewaxed oil fraction to a hydrofinishing reactor in the presence of a hydrofinishing catalyst, wherein make-up hydrogen is supplied upstream of the hydrofinishing reactor in order to increase the hydrogen partial pressure.

Advantageous Effects of Invention

According to the present invention, unconverted oil produced in hydrocrackers under various type and process conditions can be effectively utilized as a feedstock of high quality lube base oil, and higher quality lube base oil can be economically produced by means of improved reactors and reaction conditions which optimize reactions that take place during the dewaxing and hydrofinishing processes, thus attaining high industrial applicability.

BEST MODE FOR CARRYING OUT THE INVENTION

Hereinafter, a detailed description will be given of the present invention with reference to the appended drawings.

Figure 1:
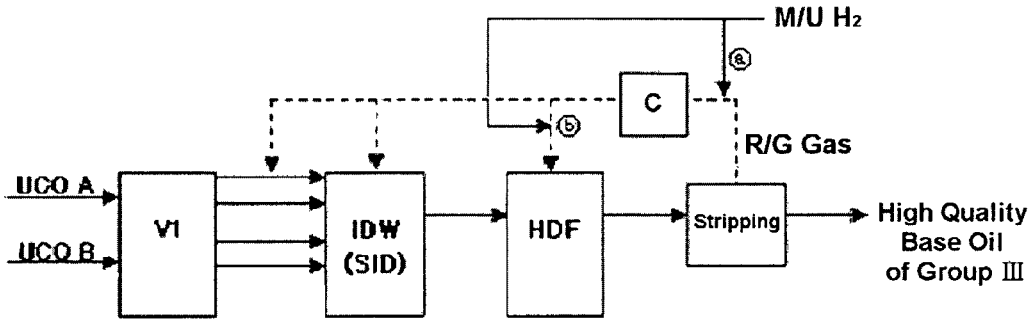
FIG. 1 schematically shows a process of manufacturing high quality lube base oil according to the present invention.

FIG. 1 schematically shows a process of manufacturing high quality lube base oil according to the present invention. As shown in this drawing, the method according to the present invention includes producing unconverted oil (UCO) of at least one kind in the same or different hydrocrackers, supplying the UCO to a vacuum distillation separator thus separating one or more fractions therefrom, supplying all or part of the separated fractions to a dewaxing reactor in the presence of an isomerization catalyst thus obtaining a dewaxed oil fraction, supplying the dewaxed oil fraction to a hydrofinishing reactor in the presence of a hydrofinishing catalyst thus obtaining a hydrofinished light oil fraction, and stripping the hydrofinished light oil fraction.

The steps of the method according to the present invention are individually specified below.

(a) Preparation of UCO

Taking into consideration the yield and properties of high quality lube base oil (Group III), hydrocracked residue of the same or different two or more kinds may be optimally mixed thus preparing a UCO feedstock suitable for producing high quality base oil (Group III). According to the present invention, even when hydrocracked residue produced in different hydrocrackers, in particular, hydrocracked residue having poor yield and properties is mixed, the method able to use it as a feedstock of high quality lube base oil corresponding to Group III is provided.

UCO A

According to an embodiment of the present invention, UCO having the typical properties of a) hydrocracked residue produced in a conventional low-pressure hydrocracker or b) hydrocracked residue produced in a hydrocracker using a feedstock (e.g. coker gas oil or heavy crude oil having a high impurity content) unfavorable for hydrocracking is referred to as UCO A. This UCO A is poor in terms of the quality of the feedstock of high quality lube base oil, including in terms of purity, impurity content, viscosity index (VI), etc., and is thus typically known to be incapable of manufacturing high quality lube base oil of Group III. The properties and yield of UCO A may be determined depending on whether crude oil used in the refinery for producing the corresponding UCO or the feedstock (coker gas oil or the like) other than vacuum gas oil (VGO) to be hydrocracked may be mixed. The general properties thereof are shown in Table 2 below.

TABLE 2

| Name | Unit | UCO A |
|---|---|---|
| API (60F) | | 33.1 |
| SG (60/60F) | | 0.8579 |
| Sulfur | ppmw | 35.8 |
| Nitrogen | ppmw | 6.0 |
| K-Vis@40° C. | cSt | 22.80 |
| K-Vis@100° C. | cSt | 4.799 |
| VI | | 135 |
| Normalized VI (K-Vis@100° C. = 4.3) | | 130 |
| Pour Point | ° C. | +45 |
| Distillation | | D-2887 |
| IBP | ° C. | 235 |
| 5% | ° C. | 347 |
| 30% | ° C. | 410 |
| 50% | ° C. | 441 |
| 70% | ° C. | 482 |
| 95% | ° C. | 543 |
| FBP | ° C. | 600 |

(Normalized VI (Viscosity Index) is obtained by calculating K-Vis@100° C. on the basis of 4.2 or 4.3)

In the case where the UCO A is subjected to vacuum distillation, the following fractions may be obtained.

TABLE 3

| Feeds | Yield (Vol %) | K-Vis@100° C. Range | VI | Sulfur (ppm) | Nitrogen (ppm) |
|---|---|---|---|---|---|
| Distillate-a | 30 | 2.9~3.1 | 113 | 20.6 | 4.1 |
| Distillate-b | 31 | 4.0~4.2 | 124 | 33.9 | 5.8 |
| Distillate-c | 21 | 4.9~5.3 | 130 | 42.5 | 7.9 |
| Distillate-d | 18 | 6.5~7.0 | 138 | 56.7 | 7.4 |

<Separation Yield of Distillates of UCO A and Main Properties>

Distillate-a/b/c/d are separated from UCO A in order to produce products according to viscosity grade, and the grade of Neutral base oil used below is represented in a manner such that the viscosity value of SUS (Saybolt Universal Seconds) at 100° F. (37.8° C.) is added with N. In the case of the above distillate fractions, Distillate-a corresponds to 70 Neutral Grade, Distillate-b corresponds to 100 Neutral Grade, Distillate-c corresponds to 150 Neutral Grade, and Distillate-d corresponds to 250 Neutral Grade, and the grade standard is shown in Table 4 below. The feedstock candidates of high quality base oil (Group III) to be manufactured according to the present invention include Distillate-b/c/d among the distillate fractions. Whether such candidates may be manufactured into base oil products corresponding to 100, 150, 250 Neutral grades using catalytic dewaxing and hydrofinishing is ascertained.

TABLE 4

| | Vis@40° C. | | Vis@100° C. | |
|---|---|---|---|---|
| Neutral | cSt | SUS | cSt | SUS |
| 70N | 13.3 | 70.8 | 3.0 | 37.0 |
| 100N | 21.5 | 104.0 | 4.0 | 39.0 |
| 150N | 31.6 | 148.0 | 4.9 | 42.4 |
| 250N | 56.1 | 257.0 | 6.5 | 47.0 |
| 500N | 107.0 | 496.0 | 11.0 | 64.0 |

<Viscosity Grade of Base Oil>

In order to manufacture base oil using Distillate-a/b/c/d prepared from UCO A, catalytic dewaxing and hydrofinishing are performed as described later. The catalytic activity of catalysts used in such processes is greatly affected by impurities such as sulfur, nitrogen or the like in the feedstock. Typically quantities of sulfur and nitrogen in the feedstock may be controlled in the level of 20~30 ppm and 5 ppm or less (particularly 3 ppm or less), respectively. If there is a lot of impurities (particularly nitrogen) in the feedstock, they may function as a catalyst poison, undesirably increasing the reaction temperature and lowering reaction selectivity, undesirably deteriorating the properties of products, such as decreasing the yield of base oil and increasing the side-reactions and the degree of VI drop.

As shown in Tables 2 and 3, Distillate-a/b/c/d prepared from UCO A have high sulfur/nitrogen contents. Among Distillate-b/c/d which are feedstock candidates for manufacturing base oil of Group III, Distillate-b having a VI of about 124 is disadvantageous because the resulting Neutral product is estimated to have a VI of 109~113 when considering the VI drop (typically about 11~15) caused upon catalytic dewaxing, thus making it impossible to manufacture high quality base oil (Group III, a VI of 120 or more). Also, Distillate-c having a VI of about 130 is disadvantageous because the resulting Neutral product is estimated to have a VI of 115~119 when considering the VI drop caused upon catalytic dewaxing, making it actually difficult to manufacture high quality base oil. Although Distillate-d may be used to manufacture base oil of Group III, it may have a low yield, a heavy boiling point range and high impurity content, thus making it difficult to manufacture base oil (Group III).

UCO B

According to an embodiment of the present invention, UCO having the typical properties of hydrocracked residue produced in a) a high-pressure hydrocracker having comparatively high hydrocracking performance resulting in high conversion efficiency or b) a hydrocracker using a feedstock (e.g. VGO) which is easily hydrocracked is referred to as UCO B. Compared to UCO A, the quality of UCO B is higher and makes a superior feedstock for producing high quality lube base oil in terms of properties including impurity content, stability and viscosity index (VI), thus making it possible to obtain base oil of Group III. In the case of such UCO produced in a hydrocracker having high hydrocracking performance, it may have comparatively good properties but the proportion of light oil fractions is relatively high, and thus the yield of desired lube base oil (such as 100/150 Neutral) becomes low. The properties and yield of UCO B also may be determined by the type of crude oil used in the corresponding refinery or the hydrocracking feedstock in addition to the kind and operation mode of a hydrocracker for producing the above UCO. The properties thereof are shown in Table 5 below.

TABLE 5

| Name | Unit | UCO B |
|---|---|---|
| API (60F) | | 36.9 |
| SG (60/60F) | | 0.8403 |
| Sulfur | ppmw | 11.2 |
| Nitrogen | ppmw | 0.7 |
| K-Vis@40° C. | cSt | 20.66 |
| K-Vis@100° C. | cSt | 4.549 |
| VI | | 140 |
| Normalized VI (K-Vis@100° C. = 4.3) | | 138 |
| Pour Point | ° C. | +39 |
| Distillation | ° C. | D-2887 |
| IBP | | 288 |
| 5% | ° C. | 349 |
| 30% | ° C. | 408 |
| 50% | ° C. | 431 |
| 70% | ° C. | 457 |
| 95% | ° C. | 513 |
| FBP | ° C. | 540 |

<Separation Yield of Distillates of UCO B and Main Properties>

When UCO B is distilled at vacuum condition, the following fractions may be obtained as shown in Table 6 below.

TABLE 6

| Feeds | Yield (Vol %) | K-Vis@100° C. Range | VI | Sulfur (ppm) | Nitrogen (ppm) |
|---|---|---|---|---|---|
| Distillate-a | 42 | 2.9~3.1 | 118 | 8.2 | 0.6 |
| Distillate-b | 33 | 4.0~4.2 | 138 | 13.6 | 0.9 |
| Distillate-c | 22 | 4.9~5.3 | 144 | 17.0 | 1.2 |
| Distillate-d | 3 | 6.5~7.0 | 142 | 22.7 | 1.3 |

Distillate-a/b/c/d prepared from UCO B have lower sulfur/nitrogen contents than do the distillates of UCO A, and are thus very ideal in terms of reactivity and selectivity when used as a feedstock of catalytic dewaxing and hydrofinishing. Among the above distillates, Distillate-b/c/d may be feedstock candidates for manufacturing lube base oil of Group III. Specifically, Distillate-b has a VI of about 138, and thus the resulting Neutral product is estimated to have a VI of 123~127 even after taking into consideration the VI drop (typically about 11~15) caused upon catalytic dewaxing, making it possible to stably manufacture lube base oil of Group III. As well, Distillate-c/d are advantageous because high quality base oil may be stably manufactured in consideration of impurities (sulfur, nitrogen, etc.) in a heavy boiling point range. Hence, in the case where base oil is manufactured from UCO B, it is possible to obtain high quality Group III lube base oil having a very good properties.

However, UCO B has drawbacks because the yield of Group III lube base oil, compared to when UCO A is used as the feedstock as mentioned above, is lower. Specifically, the largest amount of Distillate-a is produced from UCO B, but the resulting base oil from distillate-a corresponds to base oil of Group II having a light boiling point range the value of which is comparatively low, not Group III which is the product target, in terms of VI. For UCO B, the resulting products have superior properties, but have a comparatively higher proportion of light distillate the value of which is low than that of UCO A in terms of the production yield. In contrast, UCO A exhibits comparatively good yield but poor properties, thus making it impossible to produce high quality base oil of Group III. Accordingly, the present invention provides a method of optimally and efficiently producing high quality base oil of Group III in terms of the yield and properties, as explained above.

UCO Mixture

According to the research into optimization of feedstocks in terms of reaction yield and reaction conditions of lube base oil that has been being conducted for many years, when a UCO mixture obtained by mixing UCO A and UCO B at an optimal ratio so as to allow for the yield and the properties is used, high quality lube base oil of Group III can be economically manufactured. Specifically for example, UCO A and UCO B are mixed at a weight of 40:60 determined through tests, thus obtaining a UCO mixture, the properties of which are shown in Table 7 below.

TABLE 7

| Name | Unit | UCO Mixture |
|---|---|---|
| API (60F) | | 35.5 |
| SG (60/60F) | | 0.8473 |
| Sulfur | ppmw | 21.0 |
| Nitrogen | ppmw | 2.82 |
| K-Vis@40° C. | cSt | 21.468 |
| K-Vis@100° C. | cSt | 4.647 |
| VI | | 137 |
| Normalized VI (K-Vis@100° C. = 4.3) | | 134 |
| Pour Point | ° C. | +42 |
| Distillation | | D-2887 |
| IBP | ° C. | 280.8 |
| 5% | ° C. | 351.0 |
| 30% | ° C. | 412.8 |
| 50% | ° C. | 437.2 |
| 70% | ° C. | 466.3 |
| 95% | ° C. | 524.3 |
| FBP | ° C. | 555.4 |

Properties of UCO Mixture>

The separation yield of distillates of the UCO mixture and the main properties thereof are shown in Table 8 below.

TABLE 8

| Feeds | Yield (Vol %) | K-Vis@100° C. Range | VI | Sulfur (ppm) | Nitrogen (ppm) |
|---|---|---|---|---|---|
| Distillate-a | 37 | 2.9~3.1 | 116 | 12.2 | 1.7 |
| Distillate-b | 32 | 4.0~4.2 | 134 | 21.4 | 2.8 |
| Distillate-c | 22 | 4.9~5.3 | 139 | 26.9 | 3.8 |
| Distillate-d | 9 | 6.5~7.0 | 138 | 49.9 | 6.2 |

All the VI values of Distillate-b/c/d corresponding to the Group III oil fractions of the UCO mixture are 120 or more even after taking into account the VI drop of about 11~15 upon dewaxing and hydrofinishing, and thus it is possible to manufacture high quality base oil of Group III. Also the distillate yield pattern is good because the proportion of light distillate is reduced while the desired quality is still achieved, and the product yield of 100 Neutral or more which is the main product target may be maximized.

In the present invention, when a UCO mixture is used, UCO A having a VI of 110~140, a sulfur content of 20~60 ppm and a nitrogen content of 4~8 ppm, and UCO B having a VI of 115~145, a sulfur content of 5~25 ppm, and a nitrogen content of 0.1~1.5 ppm are mixed at a weight ratio of 1:1~2, and particularly 1:1.2~1.6. As such, if the amount of UCO B is less than the weight of the UCO A, the properties of the resulting base oil become unsatisfactory. In contrast, if the amount of UCO B is more than twice that of UCO A, the proportion of light oil fractions may increase in the downstream vacuum distillation process, undesirably lowering the yield of desired base oil of Group III. The UCO mixture as above may have a VI of 130~140, 20~50 ppm sulfur, and 2.5~6.5 ppm nitrogen, as seen in Table 7.

(b) Vacuum Distillation and Production of Distillate

Appropriate UCO (i.e. hydrocracked reside) in terms of desired properties and yield as above is subjected to vacuum distillation, and thus distillate fractions (cut fractions) adapted to manufacture lube base oil corresponding to the main product target are separated therefrom. All of the separated distillate fractions may be manufactured into high quality lube base oil using downstream catalytic dewaxing and hydrofinishing. However, taking into consideration the market situation and the target product group, the oil fraction corresponding to the distillate fraction the value of which is comparatively low may be transferred to a hydrocracker or other up-grading units and then utilized.

Figure 2:
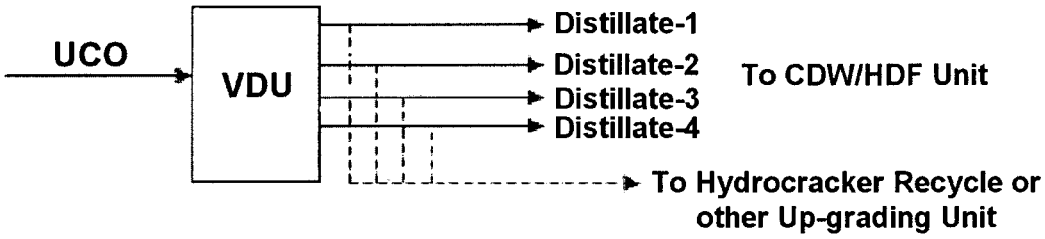
FIG. 2 schematically shows the separation of distillate fractions upon vacuum distillation according to the present invention.

FIG. 2 schematically shows the separation of distillate fractions resulting from using vacuum distillation, in which all or part of the distillate fractions produced by vacuum distillation are supplied to the downstream dewaxing unit, and the oil fractions unsuitable in terms of the desired properties according to the present invention may be introduced to other up-grading units such as hydrocracker and FCC. The above distillate fractions may be continuously supplied to the downstream unit, or may be respectively stored in additional tanks and then processed.

Thus, among the distillate fractions prepared from the UCO mixture as shown in Table 8, about 37% of the oil fraction corresponding to Distillate-a may be used for manufacturing light lube base oil (such Group II 70 Neutral) or introduced to a hydrocracker or other up-grading units in order to improve the properties, and the oil fraction corresponding to the distillate fraction having a VI of 130~140, 20~50 ppm sulfur and 2.5~6.5 ppm nitrogen may be introduced to the downstream unit in order to manufacture Group III high quality base oil.

After separation of the desired distillate fractions by viscosity and boiling point using vacuum distillation, two or more distillate fractions may be appropriately mixed, as necessary, thus ensuring an additional distillate fraction according to the desired viscosity grade.

(c) Dewaxing Using Isomerization Catalyst

A catalytic dewaxing process is performed to selectively isomerize the wax component of hydrocracked residue so as to ensure good cold properties (to ensure low pour point) and to maintain high VI. In the present invention, efficiency and yield may be increased by improving the catalyst and reactor used in the dewaxing process.

The main reaction of catalytic dewaxing is typically an isomerization reaction for converting N-paraffin into iso-paraffin in order to improve cold properties (such as pour point and cloud point). As such, the catalyst used is a bifunctional catalyst. The bifunctional catalyst is made of two active components including a metal active component (a metal site) for hydrogenation/dehydrogenation and a support having an acid site for skeletal isomerization via carbenium ions, and typically includes a zeolite type catalyst comprising an aluminosilicate support and one or more metals selected from among Groups 8 and 6 metals of the periodic table.

The dewaxing catalyst useful in the present invention comprises a support having an acid site selected from among a molecular sieve, alumina, and silica-alumina and one or more metals having hydrogenation activity selected from among Groups 2, 6, 9 and 10 elements of the periodic table. Particularly useful is Co, Ni, Pt or Pd among Groups 9 and 10 (i.e. Group VIII) metals, and also useful is Mo or W among Group 6 (i.e. Group VIB) metals.

Examples of the support having the acid site include a molecular sieve, alumina, and silica-alumina. Among them, the molecular sieve includes crystalline aluminosilicate (zeolite), SAPO, ALPO or the like, examples of a medium pore molecular sieve having a 10-membered oxygen ring including SAPO-11, SAPO-41, ZSM-11, ZSM-22, ZSM-23, ZSM-35, and ZSM-48, and a large pore molecular sieve having a 12-membered oxygen ring may be used.

Particularly useful as the support in the present invention is EU-2 zeolite in which the degree of phase transformation is controlled. When synthesis conditions change after production of pure zeolite, or when synthesis continues and exceeds a predetermined period of time even under the same hydrothermal synthesis conditions, there may occur a case in which the synthesized zeolite crystals are gradually transformed into a more stable phase. This is referred to as the phase transformation of zeolite. The present applicant maintains that it can be confirmed that isomerization selectivity is improved depending on the degree of phase transformation of zeolite, and thus superior performance may be manifested in the hydrodewaxing process.

Specifically, EU-2 zeolite according to the present invention may have a phase trans-formation index (T) in the range of $50 \leq T < 100$. As such, T may be represented by (TGA weight reduction of EU-2)/(maximum TGA weight reduction of EU-2)×100, in which the TGA weight reduction indicates that EU-2 powder is heated from 120° C. to 550° C. at a rate of 2° C./min in an air atmosphere and allowed to stand at 550° C. for 2 hours followed by measuring the weight reduction thereof using TGA (Thermogravimetric Analysis).

Typically, a catalytic reaction is performed using a three-phase fixed-bed reactor. As such, in order to ensure a high reaction yield and superior properties of lube base oil products, the contact efficiency of gas (e.g. hydrogen), liquid (feedstock) and solid (catalyst) is regarded as very important. In the present invention, the following three-phase fixed-bed reactor is applied so as to ensure a desired mixing efficiency of liquid reactant and hydrogen gas and to attain uniform temperature distribution in the reactor.

According to the present invention, the isomerization dewaxing (IDW) reactor includes a) a chimney tray for uniformly dispersing liquid and gas reactants to increase the contact efficiency of reactant and catalyst, and b) a quencher for effectively cooling heat generated by isomerization using the chimney tray.

Figure 3:
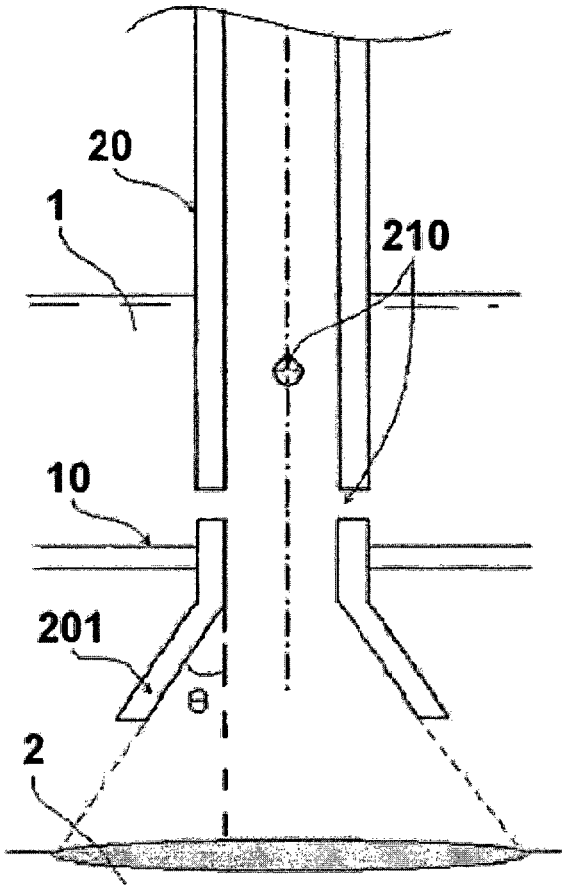
FIG. 3 schematically shows a chimney tray of an isomerization reactor according to an embodiment of the present invention.

The chimney tray is formed to uniformly disperse liquid and gas reactants to thereby increase the contact efficiency of reactants and catalyst, and is disclosed in Korean Patent Application No. 2009-0048565 (Title: high performance chimney tray of fixed-bed reactor, which is hereby incorporated by reference in its entirety into this application). The above chimney tray is schematically depicted in FIG. 3, and includes a tray 10 having through holes and a plurality of chimneys 20 perpendicularly fitted in the through holes of the tray and having one or more outlets 210. Each of the chimneys has a skirt-shaped bottom 201 that integrally extends therefrom under the tray at an angle of 10~40 with respect to the normal line direction of the tray. If the angle is less than 10°, the liquid reactant may be intensively dispersed in the center of the chimney. In contrast, if the angle is larger than 40°, the liquid reactant may be insufficiently dispersed by means of the plurality of through holes in the direction tangential to the bottom of the chimney, and droplets may thus flow along the skirt-shaped wall undesirably lowering dispersion efficiency. Furthermore, the outlets 210 are formed to penetrate diametrically opposite sides so as to be inclined with respect to the diametrical line of the transverse cross-section of the chimney. This is because the outlets are formed at a predetermined angle so that the supplied liquid reactant is subjected to centrifugal force.

Thereby, the contact efficiency of catalyst and reactant may be increased compared to when using a typical chimney tray or a bubble cap tray, so that the temperature distribution in the catalyst bed is made uniform and the reaction yield and the catalyst lifetime may increase.

Figure 4:
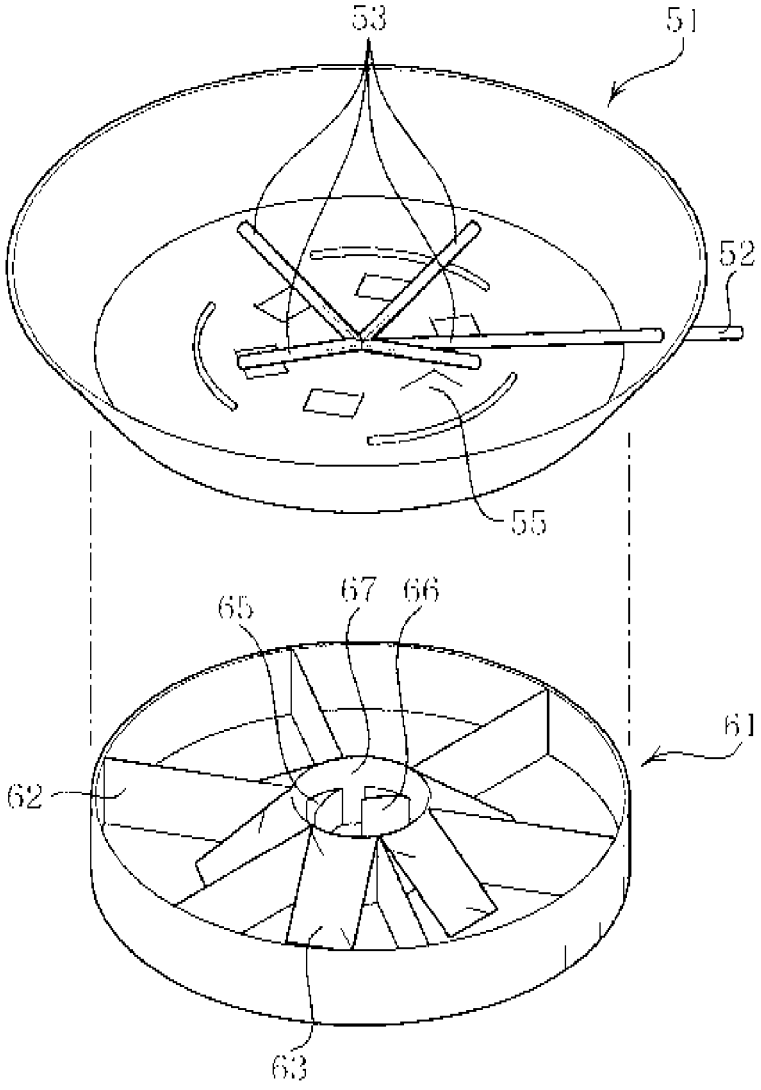
FIG. 4 schematically shows a quencher of an isomerization reactor according to an embodiment of the present invention.

Further, the dewaxing reactor according to the present invention includes a quenching zone between the catalyst beds in order to dissipate the reaction heat generated from the reactor. In this regard, Korean Patent Application No. 2009-0117940 (title: quencher for reactor) is disclosed, which is hereby incorporated by reference in its entirety into this application. The above quencher is schematically depicted in FIG. 4, and includes a quenching part 51 and a mixing part 61. In order to lengthen the residence time of a quenching fluid as possible to increase the contact thereof with a fluid, the quenching part includes fluid distribution pipes 53 branching off radially from the center thereof to spray the quenching fluid and one or more first fluid outlets 55 formed in the bottom surface thereof, and the mixing part includes baffles 63 respectively disposed under the first fluid outlets; one or more partitions 62 for dividing a space defined by the outer and inner walls of the mixing part so that the baffles are respectively positioned in the partitioned sub-spaces; and a second fluid outlet 65 for discharging fluids mixed by means of the baffles and the partitions.

The fluid distribution pipes are connected with a fluid supply pipe 52 for supplying a fluid from outside the reactor, and one end of each of the fluid distribution pipes that branch radially off is positioned at the center of the quenching part, and the other end thereof is positioned higher than the center. Furthermore, the fluid distribution pipes may have a plurality of fluid vents in the longitudinal direction thereof. The quenching fluid supply pipe according to the present invention is configured such that a plurality of branched pipes extends upwards at a predetermined angle, thus enabling the discharge of the quenching fluid from the entire three-dimensional space of the quenching part, advantageously creating eddy flow in the entire quenching part. Furthermore, the quenching part is provided in the form of the cross-sectional area thereof being reduced downwards. Thus, in the case where there is a need to increase the water level of a fluid, that level may be increased as desired even when the flow rate is low.

In this way, the quenching zone is provided, thus forming eddy flow in the entire zone and maximizing turbulence current in a mixing box so that the inner temperature distribution of the catalyst bed is made uniform, resulting in increased reaction yield and isomerization selectivity.

(d) Hydrofinishing

In a hydrofinishing process, hydrogen is added to aromatic and olefin components so as to increase stability (such as oxidation, thermal, UV, etc.) of lube base oil products The hydrofinishing process includes saturating aromatic and olefin components with hydrogen using hydrogenation in order to ensure stability of lube base oil products, and a hydrofinishing reactor may include a quencher and a chimney tray as above.

The catalyst used in the hydrofinishing process includes one or more metals selected from among Groups 6, 8, 9, 10, and 11 elements having hydrogenation activity, and particularly includes sulfides of Ni—Mo, Co—Mo or Ni—W or noble metals such as Pt or Pd.

The support may include silica, alumina, silica-alumina, titania, zirconia or zeolite having a large surface area, and particularly includes alumina or silica-alumina. The support functions to increase the dispersibility of metal to thus enhance hydrogenation performance, and the control of the acid site is considered very important in order to prevent cracking and coking of products.

The UCO which is the feedstock of lube base oil may have properties varying depending on the type of hydrocracker and the feedstock thereof. In addition to VGO typically used in the hydrocracking process, an oil fraction (e.g. coker gas oil) thermally cracked by means of a delayed coker may be used. Furthermore, in the case of UCO prepared in a hydrocracker which is an old-fashioned unit and thus has low system pressure (about 100 kg/cm$^2$g), impurity and PNA (Poly Nuclear Aromatic) contents may be high. When such UCO having high impurity and PNA contents is used as the feedstock, stability of the final lube base oil products may become problematic. In order to prevent such problems, the hydrofinishing process is performed after catalytic dewaxing, thus ensuring the stability required for base oil of Group III.

In the present invention, a differential method is provided in the hydrofinishing process in order to obtain high quality lube base oil of Group III that is very stable. Specifically, make-up hydrogen is supplied directly upstream of the hydrofinishing reactor to maintain a high hydrogen partial pressure condition, and also the reaction temperature decreases using quenching of recycle gas, thereby forming an condition favorable for a reaction equilibrium for hydrogenation of aromatics and olefins, consequently increasing the stability of final lube base oil products.

Figure 5:
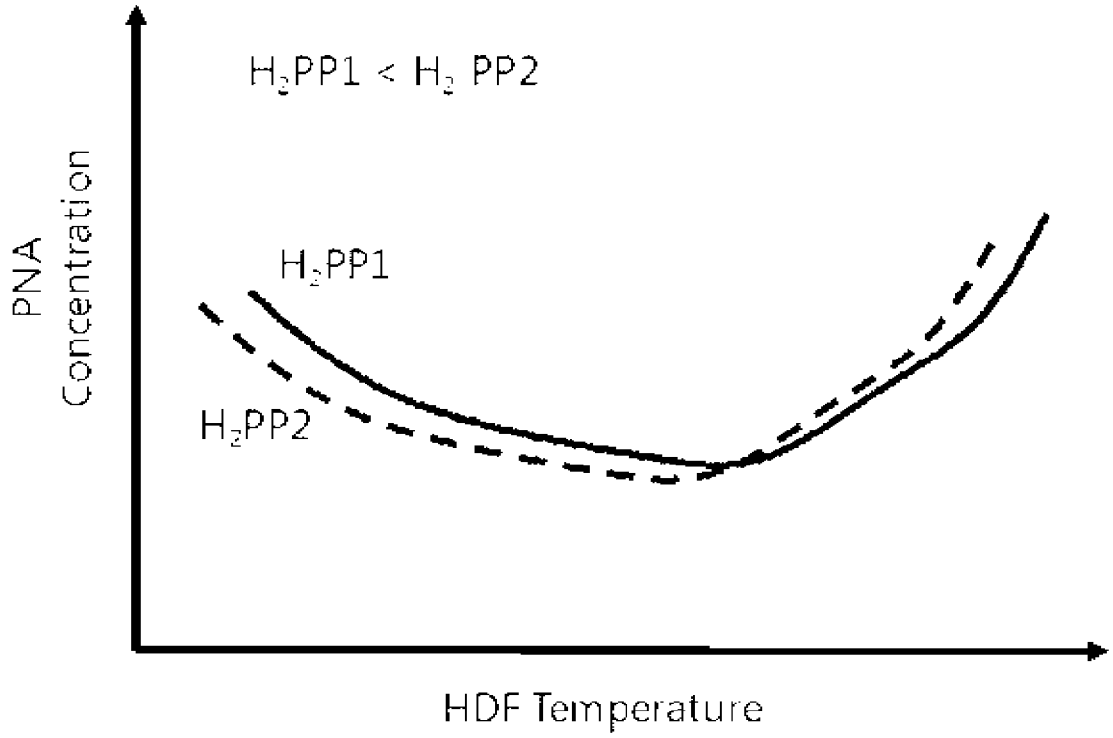
FIG. 5 is a graph showing the relationship between hydrofinishing temperature and PNA concentration at different hydrogen partial pressures in a hydrofinishing process according to the present invention.

The hydrofinishing reaction is dominated by a reversible reaction equilibrium (FIG. 5). Because this reaction reaches equilibrium at a temperature much lower than the dewaxing temperature, a low temperature approximate to the reaction equilibrium is favorable for the reaction, and also, hydrogenation becomes advantageous in proportion to an increase in hydrogen partial pressure (H2PP).

The amount of hydrogen consumed due to the reaction and loss upon typical hydroprocessing is continuously supplemented with make-up hydrogen. Generally, gas and liquid are separated from the reaction effluent, hydrogen sulfide (H2S) or ammonia (NH3) is removed from the gas, a predetermined amount of the gas is purged, as necessary, and such gas is passed through a compressor. As such, make-up hydrogen may be supplied upstream or downstream of the compressor.

Although the make-up hydrogen may be added at the general position as above, in the present invention, make-up hydrogen is supplied upstream of the hydrofinishing reactor to form a condition favorable for hydrofinishing so as to lower the reaction temperature of hydrofinishing and simultaneously to maintain a high hydrogenation condition thus increasing the stability of base oil. As seen in the schematic view of FIG. 1, when make-up hydrogen (M/U H2) is supplied to a typical position ⓐ or to a position ⓑ upstream of the hydrofinishing (HDF) reactor, the degree of decreasing H2PP is measured. The results are shown in Table 9 below.

<Main Operating Condition Base>

Distillate Feed Rate: 9,000 BD

Minimum H2/Oil Ratio upstream of IDW Reactor: 420 N m$^3$/m$^3$ of feed

TABLE 9

| | M/U H2 supply to ⓐ | M/U H2 supply to ⓑ |
|---|---|---|
| Make-Up H2 Supply | 385.0 kg/hr | 385.0 kg/hr |
| H2PP of IDW Reactor (at Inlet) | 145.8 kg/cm$^2$g | 145.8 kg/cm$^2$g |
| H2PP of HDF Reactor (at Inlet) | 134.5 kg/cm$^2$g | 140.2 kg/cm$^2$g |
| R/G Purity | About 90% or more | About 90% or more |

※ H2PP is calculated by (Rx Inlet Pressure) × (H2 Mole Flow Rate)/(Total Liquid & Vapor Mole Flow Rate)

As is apparent from Table 9, before hydrofinishing after catalytic isomerization, H2PP may have a tendency to decrease. This is because hydrogen is consumed in the course of converting a part of the UCO reactant into a light gas and a light hydrocarbon when N-paraffin is converted into iso-paraffin at relatively high temperature (300~400° C.) in the presence of a zeolite type catalyst comprising an aluminosilicate support and a noble metal upon isomerization. During isomerization, production of C1~C5 light gas and cracking of the hydrocarbon occur. This procedure consumes hydrogen. As well, as the catalyst is aged from SOR (Start Of Run) to EOR (End Of Run), the reaction temperature of the target properties (upon dewaxing, cold properties including pour point) of a product is increased. The amount of produced C1~C5 light gas is further increased and H2PP after isomerization is further decreased at higher reaction temperatures, that is, towards EOR, ultimately deteriorating the quality of base oil products including their stability.

However, in the case where make-up hydrogen is supplied upstream of the HDF reactor, the hydrogen partial pressure which was lowered due to isomerization may be made up for.

Also, H2PP values are compared at different supply positions using calculations of the hydroprocessing loop. Conventionally, when make-up hydrogen is supplied downstream of a separator, H2PP is lowered to the level of about 135 kg/cm$^2$g due to isomerization. However, when make-up hydrogen is supplied upstream of the HDF reactor, H2PP may vary depending on the reaction conditions but may be maintained at a relatively high level in the range of 140.0~200 kg/cm$^2$g, and particularly 140.0~160 kg/cm$^2$g, thereby forming conditions favorable for hydrogenation.

Specifically, if the hydrogen partial pressure is lower than 140.0 kg/cm$^2$g, conditions unfavorable for saturation or the finishing process of aromatic compounds are formed thus making it difficult to obtain stable lube base oil products. In contrast, if it is higher than 200 kg/cm$^2$g, the catalyst of the reactor may be denaturalized, and economic benefits are negated due to excessive hydrogen supply. The make-up hydrogen is typically supplied using a make-up hydrogen compressor at a temperature of 100~150° C. and a pressure slightly higher than the pressure of the supply point of the IDW/HDF high-pressure reaction loop. In the hydrofinishing process, the make-up hydrogen may be supplied at a temperature adjusted to the lower level (about 70~130° C.) depending on the reaction conditions, thus improving quenching effects to thereby effectively form conditions favorable for hydrogenation.

The appropriate reaction temperature of HDF is about 180~270° C. in consideration of the reaction equilibrium, whereas the reaction temperature of isomerization is generally 300~400° C. Thus, there may exist a considerably large difference in temperature in both reactions. This temperature difference may vary in both of them depending on catalyst conditions, but in the hydrotreating process the temperature is typically decreased as a result of heat exchange taking place between the UCO supplied for isomerization and the reaction effluent after isomerization.

According to the present invention, the reaction temperature of HDF may be lowered as a result of the combined heat exchange between the UCO feedstock and the reaction effluent after isomerization, and due to the make-up hydrogen added upstream of the HDF reactor as well as the quenching effects caused by means of the fluid supply pipe of the quencher. The reaction temperature of HDF may be adjusted so as to be favorable to creating a reaction equilibrium for the hydrogenation with the supply of compressed make-up hydrogen.

The present applicant has compared stability and HPNA (Heavy Poly Nuclear Aromatic) of lube base oil at different partial pressures in the HDF process using Distillate-d having the greatest PNA (Poly Nuclear Aromatic) content corresponding to a 250 Neutral product among distillate fractions prepared from the UCO mixture in the conventional process of preparing a feedstock of high quality base oil.

The HPNA (7-Ring+) of Distillate-d is analyzed to be 630 ppm. The isomerization is performed at the same reaction temperature using the same feed, and the reaction is carried out under different H2PP conditions using a commercially available HDF catalyst composed of alumina (Al2O3) and Pt/Pd supported thereto, thus obtaining base oil products, the stability and HPNA of which are analyzed.

TABLE 10

| | HDF H2PP = 135 kg/cm$^2$g | HDF H2PP = 140.5 kg/cm$^2$g |
|---|---|---|
| HDF Temperature (° C.) | 200 | 200 |
| UV Absorbance* (260~350 nm Max) | 0.1897 | 0.1441 |
| Thermal Stability** | 22.5 | 24 |
| HPNA Content in Base oil | 6.87 ppm | 6.46 ppm |

*UV Absorbance (260~350 nm MAX) is a wavelength corresponding to PNA. As this value is lower, PNA content is small thus obtaining high UV stability and oxidation stability.
**Thermal Stability is determined by comparing saybolt colors after 2 hours at 200° C. As this value is higher, no discoloration occurs, and thermal stability is evaluated to be good.

The results of analysis of HPNA and stability of the lube base oil obtained from Distillate-d under the same isomerization and hydrogenation conditions except for different H2PPs (H2PP=135.0/140.5 kg/cm$^2$g) showed that HPNA removal efficiency and stability of the final lube base oil products are superior under high H2PP conditions.

Also, the method of manufacturing base oil according to the present invention may further comprise stripping a recycle gas and a base oil fraction from the hydrofinished oil fraction as shown in FIG. 1, so that at least a part of the recycle gas including hydrogen is supplied upstream of the hydrofinishing reactor together with the make-up hydrogen, thus maintaining the hydrogen partial pressure of the reactor.

The invention claimed is:

1. A method of manufacturing high quality lube base oil, comprising:

producing unconverted oil of at least one kind in same or different hydrocrackers;

supplying the unconverted oil to a vacuum distillation separator to separate, one or more distillate fractions therefrom, the unconverted oil being a mixture comprising unconverted oil A having a viscosity index (VI) of 100-140, 20-100 ppm sulfur and 3-50ppm nitrogen and unconverted oil B having a viscosity index of 115-155, 5-50 ppm sulfur and 0.1-5 ppm nitrogen, and a weight ratio of unconverted oil A and unconverted oil B of the mixture being 1(A):1-2 (B);

supplying all or part of the distillate fractions to a dewaxing reactor in the presence of an isomerization catalyst to obtain a dewaxed oil fraction; and supplying the dewaxed oil fraction to a hydrofinishing reactor in the presence of a hydrofinishing catalyst to obtain a hydrofinished oil fraction, wherein make-up hydrogen is supplied upstream of the hydrofinishing reactor and downstream of the dewaxing reactor in order to increase hydrogen partial pressure in the hydrofinishing reactor and to lower a reaction temperature of hydrofinishing, and wherein the lube base oil is Group III base oil.

2. The method according to claim 1, wherein the distillate fractions separated using the vacuum distillation separator are used alone or in a mixture, and thus have a viscosity index of 130-140, 20-50 ppm sulfur, and 2.5-6.5 ppm nitrogen.

3. The method according to claim 1, wherein the mixture comprising unconverted oil A and unconverted oil B has a viscosity index of 130-140, 20-50ppm sulfur and 2.5-6.5 ppm nitrogen.

4. The method according to claim 1, wherein either or both of the dewaxing reactor and the hydrofinishing reactor include a chimney tray comprising a tray having a plurality of through holes, and a plurality of chimneys perpendicularly fitted in the through holes of the tray and having one or more outlets, each of the plurality of chimneys having a skirt-shaped bottom integrally extending therefrom under the tray at an angle of 10-40° with respect to a normal line direction of the tray.

5. The method according to claim 1, wherein either or both of the dewaxing reactor and the hydrofinishing reactor include a quencher comprising a quenching part and a mixing part, the quenching part comprising fluid distribution pipes that branch radially off from a center thereof so as to spray a quenching fluid and one or more first fluid outlets formed in a bottom surface thereof, and the mixing part comprising baffles respectively disposed under the first fluid outlets, one or more partitions for dividing a space defined by an outer wall and an inner wall of the mixing part so that the baffles are respectively positioned in partitioned sub-spaces, and a second fluid outlet for discharging fluids mixed by means of the baffles and the partitions.

6. The method according to claim 5, wherein the fluid distribution pipes are configured such that one end of each thereof is positioned at the center and the other end thereof is formed higher than the center, and are connected with a fluid supply pipe for supplying a fluid from outside the reactor.

7. The method according to claim 6, wherein the make-up hydrogen is additionally supplied to the fluid supply pipe.

8. The method according to claim 7, wherein the quencher is included in the hydrofinishing reactor, and make-up hydrogen supplied to the fluid supply pipe of the quencher falls in a temperature range of 70-130° C.

9. The method according to claim 1, wherein the isomerization catalyst comprises a support having an acid site selected from among a molecular sieve, alumina, and silica-alumina; and one or more metals selected from among Groups 2, 6, 9 and 10 elements of the periodic table.

10. The method according to claim 9, wherein the metal is selected from among platinum, palladium, molybdenum, cobalt, nickel and tungsten.

11. The method according to claim 9, wherein the molecular sieve is EU-2 zeolite having a phase transformation index (T) in a range of $50 \leq T < 100$ in which:

T =(TGA weight reduction of EU-2/maximum TGA weight reduction of EU-2) X 100 (wherein the TGA weight reduction indicates that EU-2 powder is heated from 120° C. to 550° C. at a rate of 2° C/min in an air atmosphere, allowed to stand at 550° C. for 2 hours and then measured for weight reduction using TGA (Thermogravimetric Analysis)).

12. The method according to claim 1, wherein the make-up hydrogen falls in a temperature range of 70-130° C.

13. The method according to claim 1, wherein a partial pressure of the make-up hydrogen in the hydrofinishing reactor is maintained at 140-160 /$cm^2$g.

14. The method according to claim 1, further comprising stripping a recycle gas and a base oil fraction from the hydrofinished oil fraction, in which at least a part of the recycle gas is supplied upstream of the hydrofinishing reactor together with the make-up hydrogen.

* * * * *